US009528303B1

(12) United States Patent
Lai

(10) Patent No.: US 9,528,303 B1
(45) Date of Patent: Dec. 27, 2016

(54) ANTI-THEFT SLEEVE SUPPORT

(71) Applicant: Hangzhou Lieryi Industrial Co., Ltd., Hangzhou, Zhejiang (CN)

(72) Inventor: Yongfei Lai, Zhejiang (CN)

(73) Assignee: HANGZHOU LIERYI INDUSTRIAL CO., LTD., Hangzhou (CN)

( * ) Notice: Subject to any disclaimer, the term of this patent is extended or adjusted under 35 U.S.C. 154(b) by 0 days.

(21) Appl. No.: 15/054,106

(22) Filed: Feb. 25, 2016

(30) Foreign Application Priority Data

Sep. 7, 2015 (CN) ..... 2015 1 0563523

(51) Int. Cl.
*F16M 13/00* (2006.01)
*E05B 73/00* (2006.01)
*A47F 3/00* (2006.01)

(52) U.S. Cl.
CPC ..... *E05B 73/0023* (2013.01); *A47F 3/002* (2013.01); *E05B 73/0064* (2013.01)

(58) Field of Classification Search
CPC ... E05B 73/0064; E05B 73/0023; A47F 3/002
USPC ..... 248/220.22, 222.11, 551; 206/349, 378; 211/70.6
See application file for complete search history.

(56) References Cited

U.S. PATENT DOCUMENTS 5,740,911 A * 4/1998 Chou ..... A47F 5/0861 206/1.5
6,418,014 B1 * 7/2002 Emerick, Jr. ..... G06F 1/16 292/148
6,508,355 B2 * 1/2003 Au ..... A47F 7/022 206/301
6,698,600 B1 * 3/2004 Lee ..... B25H 3/003 206/378
8,499,935 B2 * 8/2013 Hsieh ..... B25H 3/04 206/349

FOREIGN PATENT DOCUMENTS

CN 203749047 U 8/2014

* cited by examiner

*Primary Examiner* — Gwendolyn Baxter

(57) ABSTRACT

An anti-theft sleeve support, including a support and an anti-theft drop pin that is connected to the support and is snapped into the sleeve corner via the support. The support includes an octagonal hollow prism with four pairs of parallel opposite sides and a base integrated with the hollow prism. The octagonal hollow prism is capable of being inserted into the square head sleeve opposite sides; and an elastic external convex body is arranged on the exterior cylindrical surface of the opposite sides III and/or the opposite sides IV. The Invention is of simple structure and is characterized in that the support cylinder is inserted into the sleeve and rotated to a certain angle, and a drop pin is inserted into the sleeve corner to secure the support for reliable anti-theft performance.

17 Claims, 5 Drawing Sheets

ANTI-THEFT SLEEVE SUPPORT

CROSS-REFERENCE TO RELATED APPLICATIONS

The present application claims the benefit of Chinese Patent Application No. 201510563523.1 filed on Sep. 7, 2015, the contents of which are hereby incorporated by reference.

TECHNICAL FIELD

The Invention relates to an anti-theft hardware tool, in particular to an anti-theft sleeve support for orderly shelving of sleeve products.

BACKGROUND

Most of the existing goods are sold in the physical stores with a few sold online, and many physical stores with a certain scale appear in the form of a supermarket. The sleeve is a widely used hardware tool, and various different specifications of sleeves racked securely in the stores for the selection of users. To prevent the sleeves from being stolen, the dealers have used various anti-theft technologies, such as the Chinese patent CN203749047U—an anti-theft sleeve rack which comprises a body, a sleeve bearing seat and a locking mechanism. The sleeve bearing seat comprises a base and a bearing portion, wherein, the base is arranged on the body with a through-hole, and the bearing portion including an elastic slice with a fixture block on the outside surface is arranged on the base. The locking mechanism includes a locking lever. When the locking lever passes through the through-hole of the base, the elastic slice is fixed at the first position; and when the locking lever is arranged away from the through-hole of the base, the elastic slice can flexibly move between the first position and the second position. Thereby, the anti-theft sleeve rack can prevent the sleeves from being stolen by means of direct or indirect movement limit of elastic slice by the locking lever, making the sleeves under the control of the elastic slice so as not to be separated from the bearing portion.

SUMMARY OF THE INVENTION

The purpose of the Invention is to provide an anti-theft sleeve support of simple structure and convenient use.

An anti-theft sleeve support, including:

a support and an anti-theft drop pin that is connected to the support and snapped into a square head sleeve corner via the support;

the support includes an octagonal hollow prism with four pairs of parallel opposite sides and a base integrated with the hollow prism; the support is capable of being inserted into a square head sleeve;

in the octagonal hollow prism, the four pairs of opposite sides in turn comprise opposite sides I opposite sides III, opposite sides II and opposite sides IV; the opposite sides I are perpendicular to the opposite sides II, and the opposite sides III are perpendicular to the opposite sides IV;

the external spacing between the two sides of the opposite sides I and the external spacing between the two sides of the opposite sides II are equal to or slightly smaller than the inside diameter of the square head sleeve;

the inside diameter of the sleeve in the invention refers to the distance between two opposite sides of the square head sleeve;

and an elastic external convex body is arranged on the exterior cylindrical surface of the opposite sides III and/or the opposite sides IV. The external convex body is matched with the bead-shaped groove on the inner wall of the sleeve in service.

The technical scheme of the Invention can be further optimized:

Preferably, both ends of each side of the hollow octagonal prism are connected to the adjacent sides in the form of an arc; the arcs are big R and small R in turn, the spacing between two opposite arcs of the big R is smaller than the inside diameter of the square head sleeve, and that of the small R is bigger than the inside diameter of sleeve.

Preferably, as for both ends of each side of the hollow octagonal prism, one end is connected to its adjacent side in the form of an arc, and the other end and its adjacent side intersect in the form of a straight line and form an angle; the spacing between the two opposite arcs is smaller than the inside diameter of the square head sleeve, and that of the two opposite corners is bigger than the inside diameter of the square head sleeve.

Preferably, a U-shaped hollow structure is arranged on the cylindrical surface having an external convex body that is arranged in the U-shaped hollow structure and produces certain elasticity under the action of external force.

Preferably, strip-shaped hollow structures are arranged on both sides of the cylindrical surface having an external convex body that is arranged between the strip-shaped hollow structures and produces certain elasticity under the action of external force.

Preferably, the external convex body is hemispheric matching with the bead-shaped groove arranged inside the square head sleeve.

Preferably, a channel is arranged on the support, into which the anti-theft drop pin is capable of being inserted.

Preferably, the anti-theft drop pin includes an inserting piece and a connecting piece;

when the support is inserted into the sleeve, the inserting piece is inserted into the square head sleeve corner through the channel on the support to prevent the hollow prism from rotating in the sleeve;

one end of the connecting piece is fixedly connected to the inserting piece, and the other end is used for connecting to some part of the base and cannot be dismantled.

Preferably, the inserting piece of the anti-theft drop pin is a cylinder with round or polygonal section matching with the inter-space of sleeve corner after the support is inserted into the sleeve, and the connecting piece is perpendicularly connected to one end of the cylinder; the connecting piece is a cylinder, the end of which is provided with a taper cap slightly larger than the diameter of the cylinder, and an axial-groove is arranged in the middle of the cylinder and the taper cap;

a through-hole matching with the cylinder is designed at a proper position of the base.

Preferably, the inserting piece of the anti-theft drop pin is a cylinder with round or polygonal section matching with the inter-space of sleeve corner after the support is inserted into the sleeve, and a flexible connecting wire with a male connector on the end is connected to one end of the cylinder;

a female connector forming non-detachable connection to the male connector is arranged at a proper position of the base.

The design has the following principle:

The external spacing of the two sides of the opposite sides I and the external spacing of the two sides of the opposite sides II of the support cylinder are slightly smaller than the inside diameter of the sleeve or with negative tolerance; the transition between the sides is in the form of bigger arcs to smaller arcs to make the support cylinder rotate to a certain angle in a certain direction after it is easily inserted into the sleeve, and then the drop pin is inserted into a corner of sleeve so as to achieve the anti-theft purpose.

The advantages of the Invention lie in that by inserting the support cylinder into the sleeve and rotating to a certain angle, and inserting a drop pin into a sleeve corner, the support cylinder cannot be rotated in the sleeve and cannot be pulled out by hand so as to achieve the anti-theft purpose by virtue of its reliable anti-theft performance and simple structure.

DESCRIPTION OF MARKS ON THE DRAWINGS

1. Square head sleeve; 2. Hollow prism; 21. U-shaped hollow structure; 22. External convex body; 23. Channel; 24. Opposite sides I; 25. Opposite sides II; 26. Opposite sides III; 27. Opposite sides IV; 28. Strip-shaped hollow structure; 3. Base; 31. Through-hole; 4. Anti-theft drop pin; 41. Square prism; 42. Cylinder; 43. Taper cap; 44. Axial-groove.

DETAILED DESCRIPTION OF THE EMBODIMENTS

Detailed description for the technical scheme of the Invention is presented below by Embodiments in combination with the drawings.

Embodiment 1

Figure 1:
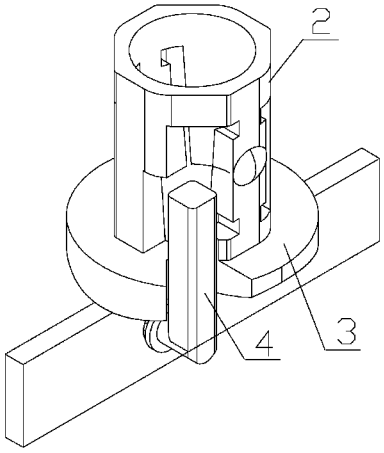
FIG. 1 is a three-dimensional structure schematic diagram of the Invention.
Figure 2:
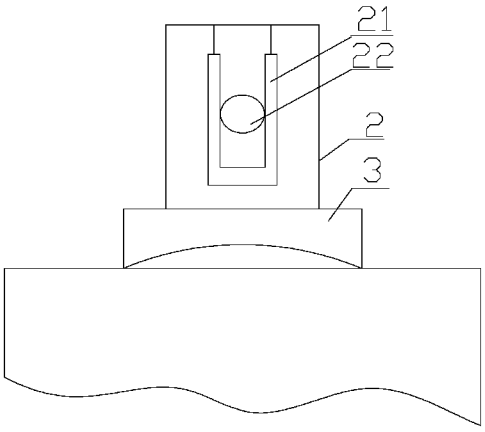
FIG. 2 is a front-view schematic diagram of rack structure of FIG. 1.
Figure 3:
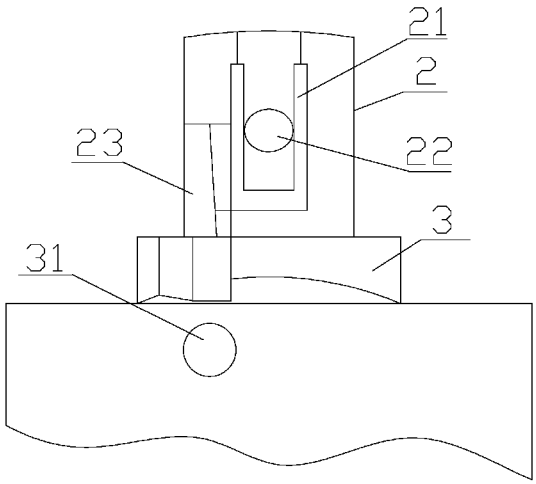
FIG. 3 is a rear-view schematic diagram of rack structure of FIG. 1.
Figure 4:
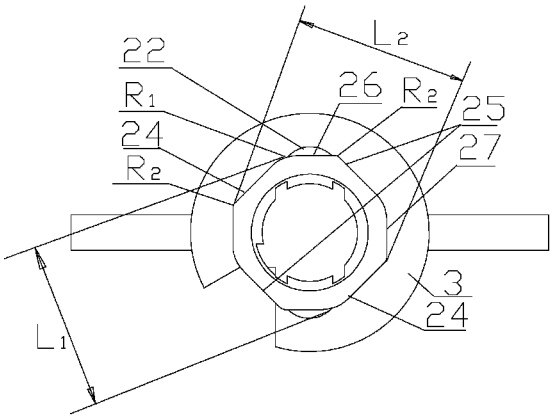
FIG. 4 is a top-view schematic diagram of rack structure of FIG. 1.
Figure 5:
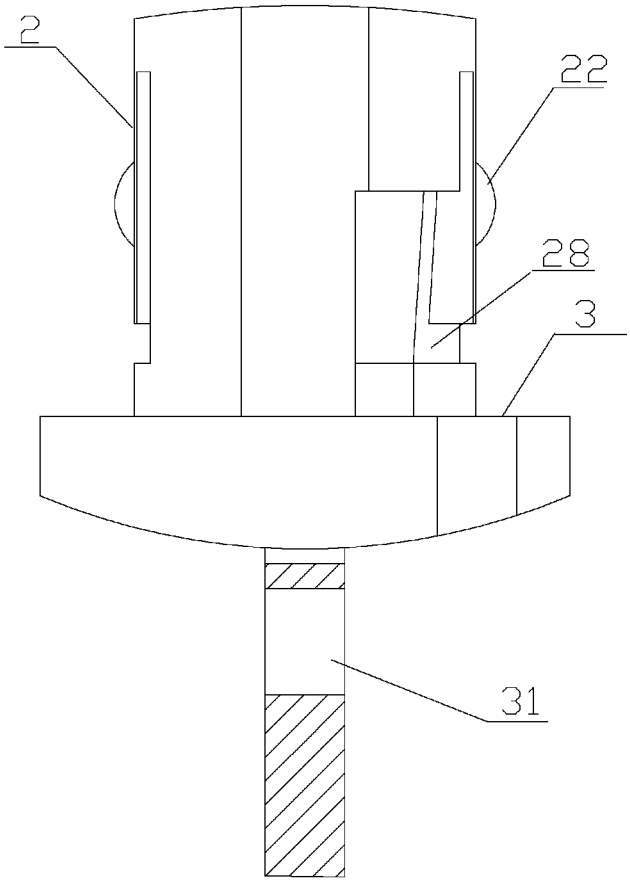
FIG. 5 is a side-view schematic diagram of rack structure of FIG. 1.
Figure 6:
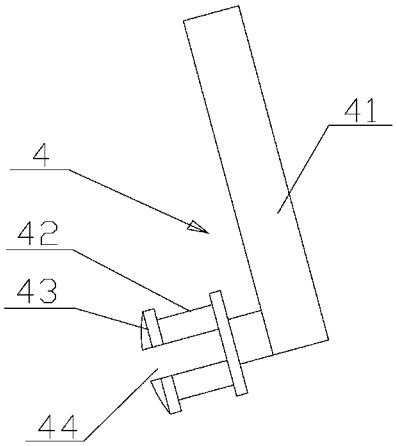
FIG. 6 is a front-view schematic diagram of anti-theft drop pin of FIG. 1.
Figure 7:
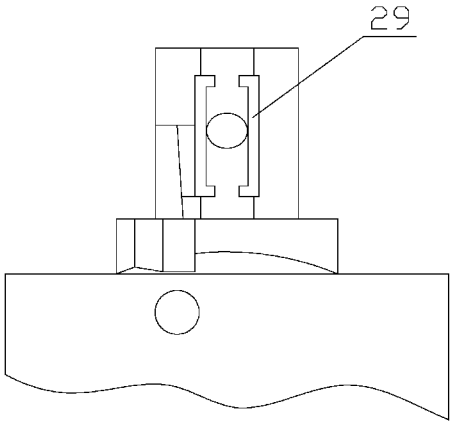
FIG. 7 is a schematic diagram of another elastomer structure on the cylinder.
Figure 8:
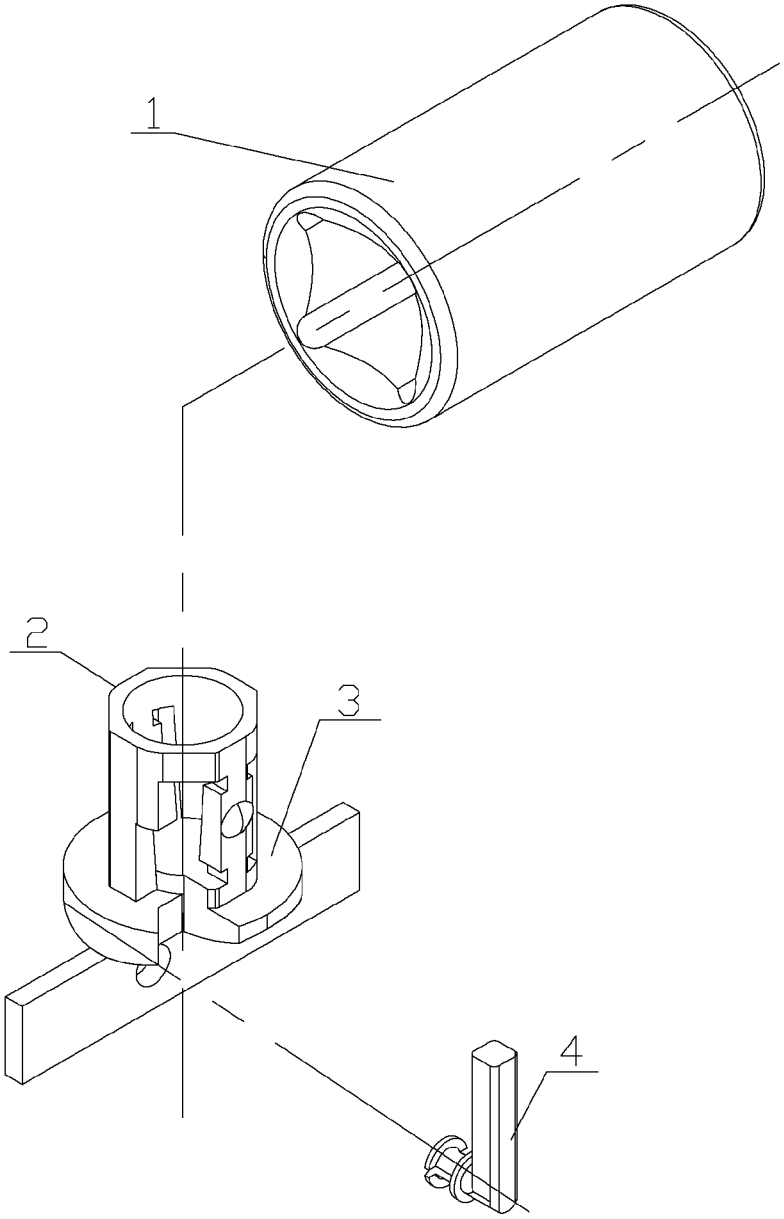
FIG. 8 is a detail diagram of the Invention installed and during use.

Referring to FIGS. 1-8, a support to prevent the sleeve from being stolen, which is made of plastics by one-step shaping technique, comprises a support and an anti-theft drop pin 4 connected to the support which is capable of being inserted into a square head sleeve 1 corner via the support.

The support includes an octagonal hollow prism 2 with four pairs of parallel opposite sides that is capable of being inserted into the square head sleeve 1 opposite sides and a base 3 integrated with the hollow prism 2.

The four pairs of opposite sides in turn comprise opposite sides I, 24, opposite sides III, 26, opposite sides II, 25 and opposite sides IV, 27. In the octagonal hollow prism 2, the opposite sides I, 24 are perpendicular to the opposite sides II, 25, the opposite sides III, 26 are perpendicular to the opposite sides IV, 27. And, the external spacing between the two sides of the opposite sides I, 24 and the external spacing between the two sides of the opposite sides II, 25 are equal to or slightly smaller than the inside diameter of the square head sleeve 1 or with negative tolerance. Both ends of each side of the octagon are connected to the adjacent sides in the form of an arc, big R, R1 and small R, R2 in turn. The spacing between the two opposite arcs of the big R, R1 is length L1 which is smaller than the inside diameter of sleeve 1, and that of the small R, R2, which the length L2 is bigger than the inside diameter of sleeve 1.

An elastic external convex body 22 is arranged on the exterior cylindrical surface of the opposite sides III 26 or the opposite sides IV 27, and the external convex body is hemispheric matching with the bead-shaped groove arranged on the inner wall of sleeve 1. The cylindrical surface has U-shaped hollow structures 21, and the hemispheric external convex body 22 is arranged between the U-shaped hollow structures and produces certain elasticity because of hollow structures on both sides of the hemispheric external convex body 22.

The anti-theft drop pin 4 includes an inserting piece and a connecting piece; the inserting piece is a square prism 41 with round or polygonal section matching with the interspace of sleeve corner after the support is inserted into the sleeve 1, and the square prism 41 in use is inserted into the corner of sleeve 1 through the channel 23 on the support; one end of the connecting piece is fixedly connected to the inserting piece, and the other end is used for connecting to some part of the base 3 and cannot be dismantled without destroying the original structure once the two parts are connected.

The inserting piece of the anti-theft drop pin 4 in the Embodiment is a square prism 41; a cylinder 42 is perpendicularly connected to one end of the cylinder, the end of which is provided with a taper cap 43 slightly larger than the diameter of the cylinder 42, and an axial-groove 44 is arranged in the middle of the cylinder 42 and the taper cap so as to make the cylinder 42 produce a proper radial elasticity; and a through-hole 31 matching with the connecting piece cylinder 42 is designed at a proper position of the base 3.

Working process of the Invention is as follows:

The opposite sides I, 24 are perpendicular to the opposite sides II, 25 of the octagonal hollow prism 2. The external spacing between the two sides of the opposite sides I, 24 and the external spacing between the two sides of the opposite sides II, 25 are slightly smaller than the inside diameter of sleeve 1. The inside diameter of sleeve 1 refers to the spacing between the opposite sides of the square head sleeve 1. The hollow prism 2 can be easily inserted into the square head sleeve 1; meanwhile, as one end of each side is connected to the adjacent side in the form of (R1). The spacing between the two opposite arcs (R1) is smaller than the inside diameter of sleeve 1. The other end is connected its adjacent side in the form of (R2), and the spacing between the two opposite arcs R2 is bigger than the inside diameter of sleeve 1. The cylinder 2 can rotate clockwise in a certain angle in the sleeve 1; anti-clockwise rotation is also available according to designs. In virtue of the spring force produced by the elastic external convex body 22 hemispheric body in the Embodiment arranged on the exterior cylindrical surface of the opposite sides III, 26, the external convex body 22 on the cylindrical surface of the opposite sides III, 26 enters into the bead-shaped groove of sleeve 1, so that the cylinder 2 cannot be easily pulled out of the sleeve.

During use, the square prism 41 in the Embodiment blocks the sleeve 1 angle after the sleeve 1 is inserted into with the anti-theft drop pin through the channel 23 of the support, so that the cylinder 2 cannot rotate within the sleeve 1 and cannot be taken out of the sleeve; and the connecting piece of anti-theft drop pin 4 is inserted into the through-hole 31 in virtue of the elasticity of cylinder 42 and the function of taper cap 43 so as to play an anti-theft role. Only by removing the connecting piece i.e., the cylinder 42, and taking out of the square prism 41 in the Embodiment, the square head sleeve 1 can be rotated.

Embodiment 2

Difference between the Embodiment 2 and the Embodiment 1 lies in that the strip-shaped hollow structures 29 are arranged on both sides of the hemispheric external convex body 22, so that the external convex body 22 can match with the bead-shaped groove in the sleeve 1 with certain elasticity.

Embodiment 3

Difference between the Embodiment 3 and the Embodiment 1 lies in that the hollow octagonal prism 2 can rotate anticlockwise to a certain angle within the square head sleeve 1 after it is inserted into the square head sleeve 1.

Embodiment 4

Difference between the Embodiment 4 and the Embodiment 1 lies in that, as for both ends of each side of the octagonal hollow prism 2, one end is connected to its adjacent side in the form of an arc, and the other end and its adjacent side intersect in the form of a straight line and form an angle; the spacing between the two opposite arcs is smaller than the inside diameter of sleeve 1, and that of the two opposite angles is bigger than the inside diameter of sleeve 1.

Embodiment 5

Difference between the Embodiment 5 and Embodiment 1 lies in that the inserting piece of the anti-theft drop pin 4 is a rod body; a flexible connecting wire with a male connector on the end is connected to one end of the rod body; and the male connector forms non-detachable connection to the female connector arranged at a proper position of the base 3.

e.g., if the male connector is a sphere, the female connector will be a spherical hole with the same diameter with the depth slightly bigger than its radius.

While the patent application has been described in terms of preferred embodiments, those skilled in the art will recognize that the patent application can be practiced with modifications within the spirit and scope of the appended claims.

What is claimed is:

1. An anti-theft sleeve support, comprising:

a support and an anti-theft drop pin (4) that is connected to the support and snapped into a square head sleeve (1) corner via the support;

wherein the support comprises an octagonal hollow prism (2) with four pairs of parallel opposite sides and a base (3) integrated with the hollow prism (2), the octagonal hollow prism (2) is capable of being inserted into the square head sleeve (1);

the four pairs of parallel opposite sides in turn comprise opposite sides I, (24), opposite sides III, (26), opposite sides II, (25), and opposite sides IV, (27); the opposite sides I, (24) are perpendicular to the opposite sides II, (25), and the opposite sides III, (26) are perpendicular to the opposite sides IV, (27);

the external spacing between the two sides of the opposite sides I, (24) and the external spacing between the two sides of the opposite sides II, (25) are equal to or slightly smaller than the inside diameter of the square head sleeve (1);

and an elastic external convex body (22) is arranged on the exterior cylindrical surface of the opposite sides III, (26) or the opposite sides IV, (27).

2. The anti-theft sleeve support according to claim 1, wherein, both ends of each side of the hollow prism (2) are connected to the adjacent sides in the form of an arc; the arcs are big R, (R1) and small R, (R2) in turn, the spacing between two opposite arcs big R, (R1) is smaller than the inside diameter of the square head sleeve (1), and that of small R, (R2) is bigger than the inside diameter of the square head sleeve (1).

3. The anti-theft sleeve support according to claim 2, wherein, a U-shaped hollow structure (21) is arranged on the cylindrical surface having an external convex body (22) that is arranged in the U-shaped hollow structure and produces certain elasticity under action of an external force.

4. The anti-theft sleeve support according to claim 2, wherein, strip-shaped hollow structures (29) are arranged on both sides of the cylindrical surface having an external convex body (22) that is arranged between the strip-shaped hollow structures (29) and produces certain elasticity under the action of external force.

5. The anti-theft sleeve support according to claim 2, wherein, the external convex body (22) is hemispheric matching with a bead-shaped groove arranged inside the square head sleeve (1).

6. The anti-theft sleeve support according to claim 2, wherein, a channel (23) is arranged on the support, the anti-theft drop pin (4) is capable of being inserted into the channel (23).

7. The anti-theft sleeve support according to claim 6, wherein, the anti-theft drop pin (4) comprises an inserting piece and a connecting piece;

when the support is inserted into the sleeve (1), the inserting piece is inserted into the square head sleeve (1) corner through the channel (23) on the support to prevent the hollow prism (2) from rotating in the sleeve; and one end of the connecting piece is fixedly connected to the inserting piece, and the other end is used for connecting to some part of the base (3) and is not capable of being dismantled.

8. The anti-theft sleeve support according to claim 7, wherein, the inserting piece of the anti-theft drop pin (4) is a prism (41) with round or polygonal section matching with an inter-space of sleeve (1) corner after the support is inserted into the sleeve (1); the prism (41) is perpendicularly connected with a connecting piece at one end; the connecting piece is a cylinder (42), the end of which is provided with a taper cap (43) slightly larger than the diameter of the cylinder (42), and an axial-groove (44) is arranged in the middle of the cylinder (42) and the taper cap (43);

a through-hole (31) matching with the cylinder (42) is arranged at a proper position of the base (3).

9. The anti-theft sleeve support according to claim 7, wherein, the inserting piece of the anti-theft drop pin (4) is a prism (41) with round or polygonal section matching with the inter-space of sleeve corner after the support is inserted into the sleeve; one end of the prism (41) is provided with a flexible wire, the end of the flexible wire has a male connector; a female connector forming non-detachable connection to the male connector is arranged at a proper position of the base (3).

10. The anti-theft sleeve support according to claim 2, wherein, a channel (23) is arranged on the support, the anti-theft drop pin (4) is capable of being inserted into the channel (23).

11. The anti-theft sleeve support according to claim 10, wherein, the anti-theft drop pin (4) includes an inserting piece and a connecting piece;

when the support is inserted into the sleeve (1), the inserting piece is inserted into the square head sleeve (1) corner through the channel (23) on the support to prevent the hollow prism (2) from rotating in the sleeve; and one end of the connecting piece is fixedly connected to the inserting piece, and the other end is used for connecting to some part of the base (3) and is not capable of being dismantled.

12. The anti-theft sleeve support according to claim 11, wherein, the inserting piece of the anti-theft drop pin (4) is a prism (41) with round or polygonal section matching with the inter-space of sleeve (1) corner after the support is inserted into the sleeve (1); the prism (41) is perpendicularly connected with a connecting piece at one end; the connecting piece is a cylinder (42), the end of which is provided with a taper cap (43) slightly larger than the diameter of the cylinder (42), and an axial-groove (44) is arranged in the middle of the cylinder (42) and the taper cap (43);

a through-hole (31) matching with the cylinder (42) is arranged at a proper position of the base (3).

13. The anti-theft sleeve support according to claim 11, wherein, the inserting piece of the anti-theft drop pin (4) is a prism (41) with round or polygonal section matching with the inter-space of sleeve corner after the support is inserted into the sleeve; one end of the prism (41) is provided with a flexible wire, the end of the flexible wire has a male connector; a female connector forming non-detachable connection to the male connector is arranged at a proper position of the base (3).

14. The anti-theft sleeve support according to claim 1, wherein, as for both ends of each side of the hollow prism (2), one end is connected to its adjacent side in the form of an arc, and the other end and its adjacent side intersect in the form of an angle; the spacing between the two opposite arcs is smaller than the inside diameter of the square head sleeve (1), and that of the two opposite angles is bigger than the inside diameter of the square head sleeve (1).

15. The anti-theft sleeve support according to claim 14, wherein, a U-shaped hollow structure (21) is arranged on the cylindrical surface having an external convex body (22) that is arranged in the U-shaped hollow structure and produces certain elasticity under the action of external force.

16. The anti-theft sleeve support according to claim 14, wherein, strip-shaped hollow structures (29) are arranged on both sides of the cylindrical surface having an external convex body (22) that is arranged between the strip-shaped hollow structures (29) and produces certain elasticity under the action of external force.

17. The anti-theft sleeve support according to claim 14, wherein, the external convex body (22) is hemispheric matching with a bead-shaped groove arranged inside the square head sleeve (1).

* * * * *